US005503517A

United States Patent [19]

Derby

[11] Patent Number: 5,503,517

[45] Date of Patent: Apr. 2, 1996

[54] SLIP SHEET AND METHOD OF USE OF SAME

[75] Inventor: Norwin C. Derby, Sherman, Tex.

[73] Assignee: B.A.G. Corporation, Dallas, Tex.

[21] Appl. No.: 177,371

[22] Filed: Jan. 5, 1994

[51] Int. Cl.[6] ..... B65G 69/00

[52] U.S. Cl. ..... 414/786; 29/DIG. 1; 29/426.1; 29/458; 29/799; 53/473; 53/235; 414/608; 414/661; 414/403; 414/904

[58] Field of Search ..... 414/607, 608, 414/661, 280, 904, 498, 411, 403, 786; 53/473, 235; 29/426.1, 426.3, 428, 458, DIG. 1, 700, 799

[56] References Cited

U.S. PATENT DOCUMENTS

| | | | |
|---|---|---|---|
| 1,590,496 | 6/1926 | Carr | 414/661 |
| 3,059,787 | 10/1962 | Forsyth | 414/904 X |
| 4,655,672 | 4/1987 | Sinclair et al. | 414/607 |
| 4,688,979 | 8/1987 | Kupersmit | 414/412 X |
| 5,257,725 | 11/1993 | Volk, Jr. et al. | 414/608 X |

FOREIGN PATENT DOCUMENTS

| | | | |
|---|---|---|---|
| 109191 | 5/1984 | European Pat. Off. | 414/608 |
| 202854 | 3/1966 | Sweden | 414/608 |
| 1728126 | 4/1992 | U.S.S.R. | 414/661 |

*Primary Examiner*—Frank E. Werner
*Attorney, Agent, or Firm*—Michael A. O'Neil

[57] ABSTRACT

A slip sheet for use with bulk containers and a method of use of such slip sheet. An empty bulk container is detachably secured to a slip sheet including one or more movable edges. The slip sheet and container can be manipulated and transported with a forklift or similar machinery. The slip sheet can be easily detached from the container after use via the movable edges.

8 Claims, 2 Drawing Sheets

SLIP SHEET AND METHOD OF USE OF SAME

TECHNICAL FIELD

The present invention relates to slip sheets, and more specifically, to a reusable, recyclable, slip sheet and method of use of same with bulk containers.

BACKGROUND OF THE INVENTION

Bulk containers have gained popularity in the recent past as the preferred means by which to contain and transport flowable materials. Naturally associated with these bulk containers is the practical problem of how to manipulate and transport the containers when filled. Attendant concerns include the care needed not to rupture or damage the container during handling and transportation as well as the speed and efficiency with which the containers can be transported or otherwise manipulated.

Traditionally, one of several methods has been employed to transport or otherwise manipulate filled bulk containers: (1) lifting and/or moving the container by direct contact with the container; (2) lifting and/or moving the container using pallets and forklifts or other similar machines; and (3) lifting and/or moving the container using slip sheets.

The first method, lifting and/or moving the container by direct contact with the container, presents several significant disadvantages. Machines or other expensive equipment are needed to lift and move the containers regardless of whether the machines or equipment directly or indirectly contact the bag. Moreover, direct contact with the container introduces the potential of rupturing or otherwise damaging the container. The sheer weight of these filled containers can present problems with any method of direct contact. Finally, direct contact methods traditionally used are typically slow and therefore uneconomical.

The above-identified problems and concerns associated with any direct contact methods of lifting and/or moving the containers are not cured with traditional non-direct contact methods employing pallets. Typically, pallets made of wood, corrugated cardboard or similar materials are used to lift and/or move filled containers. Fork lifts or other similar heavy machinery are used to contact and direct the movement of the pallets upon which the containers rest. Unfortunately, problems exist with this method as well. For example, pallets made of wood or other fibrous materials such as corrugated cardboard, etc., tend to shed fibers during the process. This shedding can create not only additional costs associated with clean-up, but can present safety as well as contamination concerns, depending upon the materials within the containers. Moreover, pallets formed from traditional materials are heavy, uneconomical and non-recyclable or -reusable.

Finally, the use of traditional slip sheets to lift and/or move containers also presents practical difficulties, including cost efficiency and ease of use. Slip sheets are attached to the container for use and then detached once the container is lifted and/or moved. Slip sheets currently available are not shaped properly to facilitate quick, inexpensive and easy movement of bulk containers. Moreover, traditional methods of attachment and detachment are inadequate when used in connection with bulk containers.

Thus a need has arisen for a method of lifting and/or moving filled bulk containers utilizing inexpensive, reusable and recyclable slip sheets to provide safe, quick and economical transportation of the containers.

SUMMARY OF THE INVENTION

The present invention overcomes the foregoing and other problems associated with the prior art by providing a method of lifting and/or moving a container using a slip sheet made from inexpensive, recyclable, reusable and non-shedding materials. The slip sheet of the present invention is shaped to allow for easy and quick use. Additionally, the slip sheet is easily detachable from the container after use.

According to the present method, a slip sheet constructed from inexpensive, recyclable, reusable and non-shedding material is placed under an unfilled container. The slip sheet is then attached to the container along the bottom panel of the container. The method of attachment provides enough of a bond to allow the slip sheet to properly function during operation but also detach from the container quickly and easily once the slip sheet in no longer needed.

The present slip sheet has one or more movable edges which allow a forklift or other machinery ease of manipulation of the slip sheet. Once attached, the forklift or other machinery can transport and otherwise manipulate the slip sheet and the container much like when a pallet is utilized. When the slip sheet is no longer needed, it can be easily detached from the container. Due to the unique material from which the slip sheet is constructed, the slip sheet can be reused and/or recycled. Also, since the slip sheet material is non-shedding in nature, there is no need for additional cleanup or concerns regarding contamination of the materials being contained and transported.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE DRAWINGS

Figure 1:
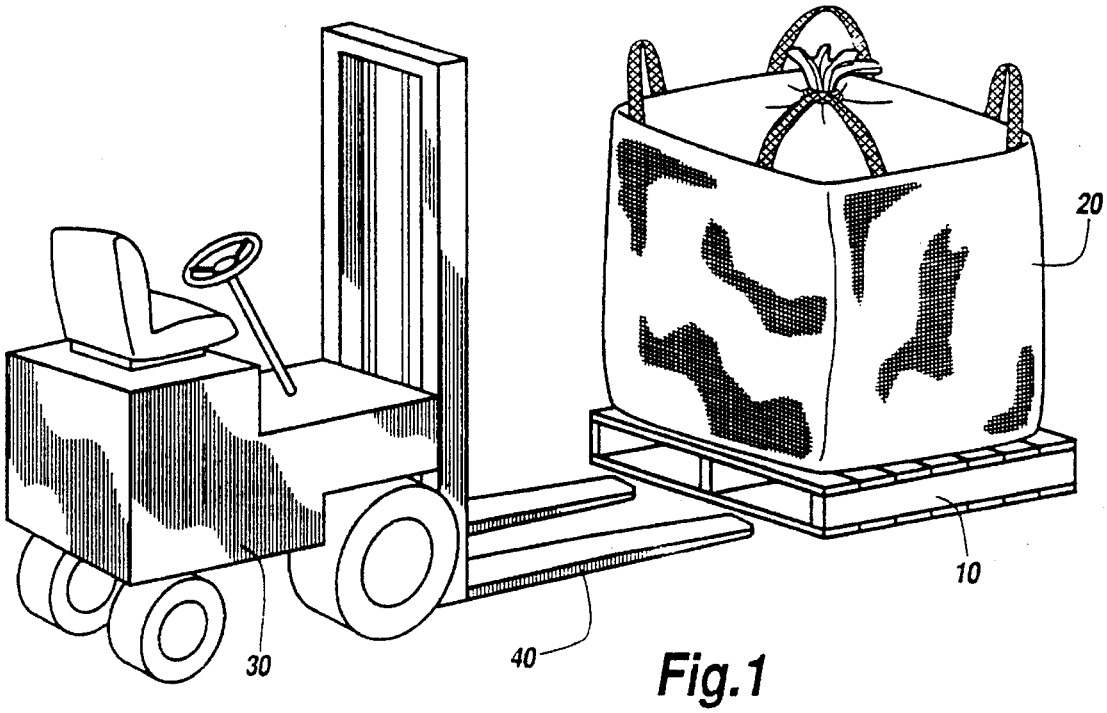
FIG. 1 illustrates a prior art method of lifting and/or moving bulk containers using pallets and a fork lift.

Referring now to FIG. 1, there is shown a prior art method of lifting and/or moving a bulk container. According to this method, a pallet 10 typically constructed of wood or some fibrous material is placed underneath a bulk container 20. A fork lift 30 or other similar machinery is then used to lift and/or move the pallet 10 and bulk container 20. The hollow nature of the pallet 10 allows the forks 40 of the fork lift 30 or similar machinery to lift and manipulate the pallet 10 without directly contacting the bulk container 20. As previously discussed, several practical problems are associated with this method.

Figure 2:
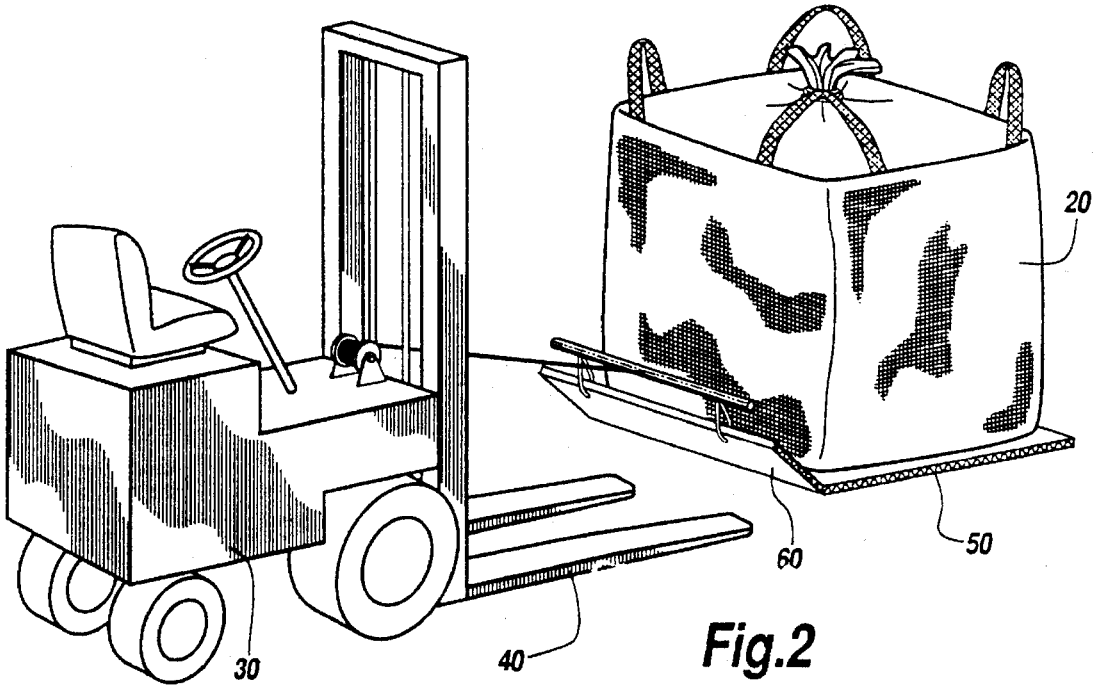
FIG. 2 illustrates an embodiment of the present method of lifting and/or moving a bulk container using a slip sheet.

FIG. 2 (in which like elements are designated with like reference numerals) illustrates a slip sheet 50 used in connection with the present method. Here, a bulk container 20 is placed upon the slip sheet 50. Once the bulk container 20 is filled, it can then be manipulated and transported by the forklift 30 or similar machinery via the slip sheet 50. The forks 40 of the forklift 30 or similar machinery are placed under the slip sheet 50 rather than inside of traditional pallets 10 (FIG. 1). The slip sheet 50 has one or more edges 60 which are capable of movement about the plane of the slip sheet 50 and which facilitate the manipulation of the slip sheet 50 and bulk container 20.

The slip sheet 50 is ideally constructed of a single piece of corrugated polypropylene or high density polyethylene. Using these types of materials provides both a rugged slip sheet 50 as well as one that is reusable, recyclable and non-shedding.

Figure 3:
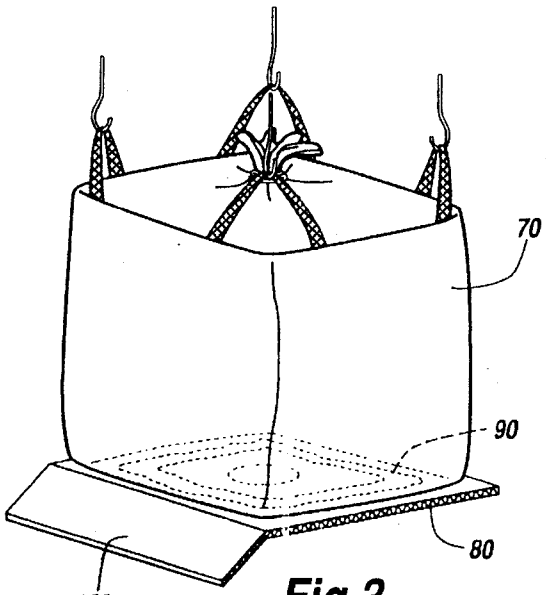
FIG. 3 illustrates a container resting on a slip sheet used in the present method of lifting and/or moving a bulk container.

In FIG. 3, an empty container 70 is placed upon a slip sheet 80. The slip sheet 80 is detachably secured to the bottom portion of the container 70 via one of several methods: (1) adhesive, glue or cohesive; (2) sewing; or (3) staples. For purposes of this Application, the term "cohesive" will be used to refer to any substance which adheres only to itself. If an adhesive, glue or cohesive 90 is used, the adhesive, glue or cohesive 90 is applied in a pattern and in an amount which allows for the slip sheet 80 to be secure during its use but easily detach from the container 70 after the slip sheet 80 is no longer needed. The amount of adhesive, glue or cohesive 90 needed depends upon the application and the materials of the slip sheet 80 as well as the container 70 used. Although an adhesive, glue or cohesive 90 is the preferred method of attachment, the amount and arrangement of stitches and/or staples is similarly decided by the application, machinery and materials used.

Once the slip sheet 80 is detachably secured to the container 70, the container 70 is filled and can be manipulated and/or transported with a forklift or similar machinery. The slip sheet 80 functions to close a discharge spout (shown in FIG. 5), if present, and also keeps the bottom of the container clean.

Figure 5:
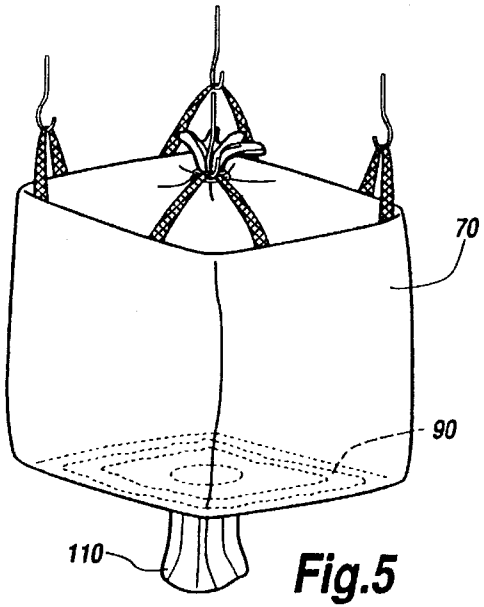
FIG. 5 illustrates the container absent the slip sheet.
Figure 4:
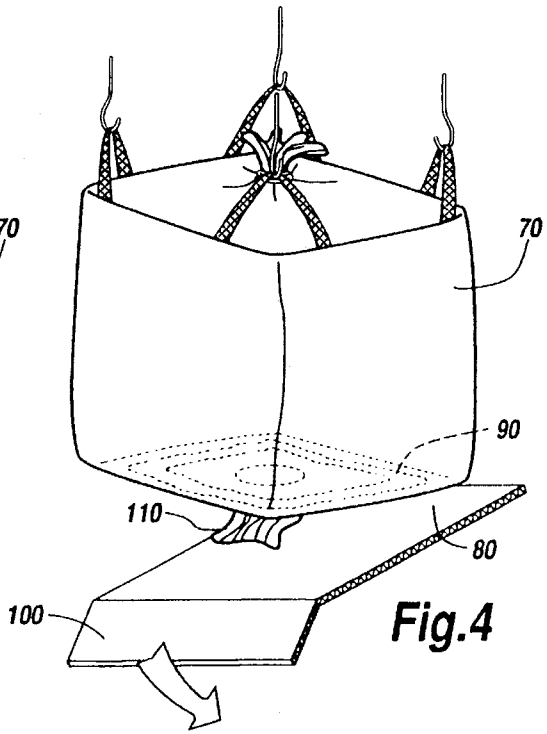
FIG. 4 illustrates the container being separated from the slip sheet.

The slip sheet 80 includes one or more edges 100 which are capable of movement about the plane of the slip sheet 80 and which facilitate the manipulation and transportation of the container 70. As illustrated in FIG. 2, the edges 60 can be grasped and lifted and/or used to actually move the slip sheet 50 and container 20. Referring now to FIGS. 4 and 5, once the slip sheet 80 is no longer needed to manipulate or transport the container 70, the slip sheet 80 can be detached from the container 80. By grasping one or more of the edges 100 of the slip sheet 80 and exerting a force in a generally downward direction, the slip sheet 80 will detach from the container 70. FIG. 5 illustrates how the discharge spout 110 of the container, if any, will drop into place once the slip sheet 80 is separated from the container 70.

Figure 6:
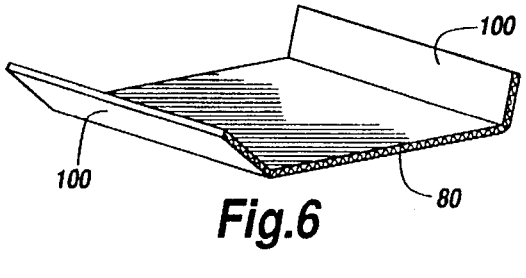
FIG. 6 illustrates a slip sheet having two raised edges used in connection with the present method.
Figure 7:
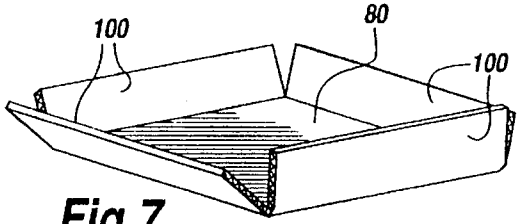
FIG. 7 illustrates a slip sheet having four raised edges used in connection with the present method.
Figure 8:
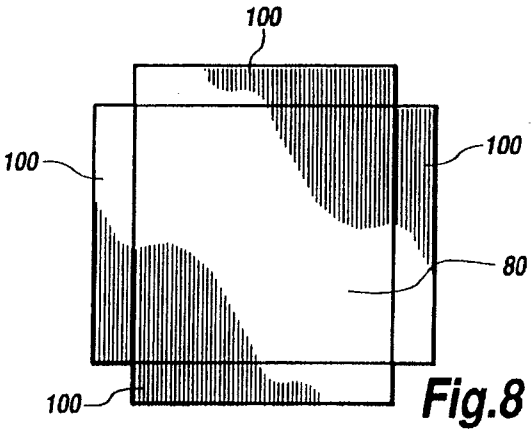
FIG. 8 is a top view of a slip sheet having four raised edges.

FIGS. 6–8 demonstrate some of the various configurations of movable edges 100 that the slip sheet 80 can have to facilitate attachment, manipulation, transportation and detachment of the slip sheet 80, depending upon the machinery used to manipulate or transport the container 70. In one embodiment (FIG. 6), the slip sheet 80 has two, opposing movable edges 100. In another embodiment (FIGS. 7 and 8), four movable edges are included. Although two and four edges are illustrated, any combination of numbers and placement of such edges can be utilized, if desired.

Although preferred embodiments of the invention have been illustrated in the accompanying drawings and described in the foregoing Detailed Description, it will be understood that the invention is not limited to the embodiments disclosed, but is capable of numerous rearrangements and modifications of parts and elements without departing from the spirit of the invention.

I claim:

1. A method for transporting a flexible bulk container having a sidewall, and a bottom wall of predetermined size and shape using a slip sheet, said method comprising the steps of:

(a) placing the slip sheet on a supporting surface, said slip sheet formed of flexible material, dimensioned to conform substantially to the size and shape of the bottom wall of the flexible bulk container, having at least one integral extension extending beyond the size and shape of the bottom wall of the flexible bulk container, said extension capable of movement about the plane of the slip sheet;

(b) placing an adhesive material on the slip sheet in a pattern and amount which allows for the slip sheet to be secure during use but easily detachable from the flexible bulk container after use;

(c) subsequent to steps (a) and (b), detachably securing the slip sheet to an empty flexible bulk container of predetermined cross section by placing the empty flexible bulk container in contact with the adhesive;

(d) subsequent to step (c), filling the flexible bulk container;

(e) subsequent to step (d), applying a pulling force through a cable connected to the extension thereby transporting the slip sheet and flexible bulk container; and (f) subsequent to step (e), detaching the slip sheet from the container by grasping one or more edges of the slip sheet and exerting a generally downward force.

2. The method of claim 1 wherein the slip sheet is a single piece of corrugated polyproplyene.

3. The method of claim 1 where in the slip sheet is a single piece of high density polyethylene.

4. The method of claim 1 where in the adhesive material of step (b) is instead a cohesive material.

5. The method of claim 1 wherein the adhesive material of step (b) is a conventional glue.

6. The method of claim 1 whereby in step (b) sewing is used to detachably secure the slip sheet to the flexible bulk container instead of adhesive.

7. The method of claim 1 whereby in step (b) stapling is used to detachably secure the slip sheet to the flexible bulk container instead of adhesive.

8. The method of claim 1 whereby in step (e) the applied pulling force moves the slip sheet and flexible bulk container connected thereto onto the forks of a conventional fork lift and the conventional fork lift transports the slip sheet and flexible bulk container to another location.

* * * * *